US005833448A

United States Patent [19]

Doucet et al.

[11] Patent Number: 5,833,448

[45] Date of Patent: Nov. 10, 1998

[54] CHILD RESISTANT LIGHTER

[75] Inventors: Michel Doucet, Bains Sur Oust, France; Enrique Amoros Nollas, Reus, Spain; Rene Frigiere, Allaire, France

[73] Assignee: BIC Corporation, Milford, Conn.

[21] Appl. No.: 922,040

[22] Filed: Sep. 2, 1997

[51] Int. Cl.[6] ..... F23Q 7/12

[52] U.S. Cl. ..... 431/153; 431/255

[58] Field of Search ..... 431/255, 153

[56] References Cited

U.S. PATENT DOCUMENTS 5,228,849 7/1993 Frigiere ..... 431/153
5,531,591 7/1996 Yamazaki ..... 431/153
5,662,466 9/1997 Cheng ..... 431/153

*Primary Examiner*—Carroll B. Dority
*Attorney, Agent, or Firm*—Pennie & Edmonds LLP

[57] ABSTRACT

A lighter of the disposable type, ignition of which requires depression of an actuator that is resistant to the manipulations of unintended users. The lighter is normally maintained in a position that prevents depression of the actuator through the incorporation of a mechanism that increases the difficulty of operation. The safety mechanism requires a tilted displacement in order to allow full depression of the actuator and activation of an ignition means. When the mechanism is so displaced through the application of force by a user, it cannot remain displaced without continuous application of such force and will return to the normal, blocking, position when the force is removed.

16 Claims, 5 Drawing Sheets

CHILD RESISTANT LIGHTER

BACKGROUND OF THE INVENTION

1. Technical Field

The present invention relates to a lighter employing an ignition system which presents increased difficulty of operation by unintended users and, more particularly, a piezoelectric lighter with such system.

2. Discussion of the Related Art

Disposable gas lighters are available in a variety of forms. One common element of disposable lighters, though, is an actuator pad or lever used to initiate the flow of fuel. An actuator pad is operated in conjunction with a spark producing mechanism so that the flow of fuel is ignited soon after it commences. For example, lighters employing conventional spark wheels require a user to rotate a toothed spark wheel against a flint in order to generate a spark. The user then depresses the actuator pad, releasing gas and producing a flame.

Another means of ignition for disposable lighters employs a piezoelectric mechanism. In this type of ignition mechanism, a piezoelectric element, such as a crystal, is struck by a hammer in order to produce an electric spark. The spark is conducted to the opening of the fuel valve to ignite the gaseous fuel. The actuator pad, upon forced depression by a user, commences both the flow of the fuel and the ignition process. An example of such a piezoelectric ignition mechanism is disclosed in U.S. Pat. No. 5,262,697, entitled "Piezoelectric Mechanism for Gas Lighters."

As with spark wheel ignition mechanisms, measures have been introduced to prevent activation of piezoelectric mechanisms by unintended users such as children 5 years old and younger. One typical method employed is to incorporate a latch member under the actuator pad that inhibits depression of the actuator pad. Examples of such mechanisms are shown in U.S. Pat. Nos. 5,435,719, 5,584,682, and 5,636,979.

There remains, however, a need in the art for mechanisms which increase the difficulty of operation by unintended users and at the same time are user-friendly for the intended user.

SUMMARY OF THE INVENTION

It is thus an object of this invention to provide a lighter that is easily operated by an adult, but which is resistant to operation by young children.

This and other objectives are met by a lighter according to the present invention, with an elongated body defining a fuel reservoir and including a valve for dispensing such fuel. The lighter further includes an actuator that, upon depression, activates the ignition system, which requires the release of fuel from the reservoir and activation of a piezoelectric mechanism which makes a spark. Depression of the actuator is normally barred, however, by a blocking mechanism. Displacement of the blocking mechanism in the specified manner allows the actuator to be depressed. The blocking mechanism, which is integral to the actuator, is displaced through pressure by a user. Upon removal of the displacing force the blocking mechanism returns to its initial blocked position, once again preventing the actuator from being depressed sufficiently to activate the ignition system.

The blocking mechanism of the current invention requires tilted displacement in both the horizontal and vertical directions in order to permit ignition.

BRIEF DESCRIPTION OF THE DRAWINGS

These and other objects, features, and advantages of the invention will become more readily apparent from the following detailed description which should be read in conjunction with the accompanying drawings, in which like elements are labeled similarly, and in which.

DETAILED DESCRIPTION OF THE INVENTION

Figure 1:
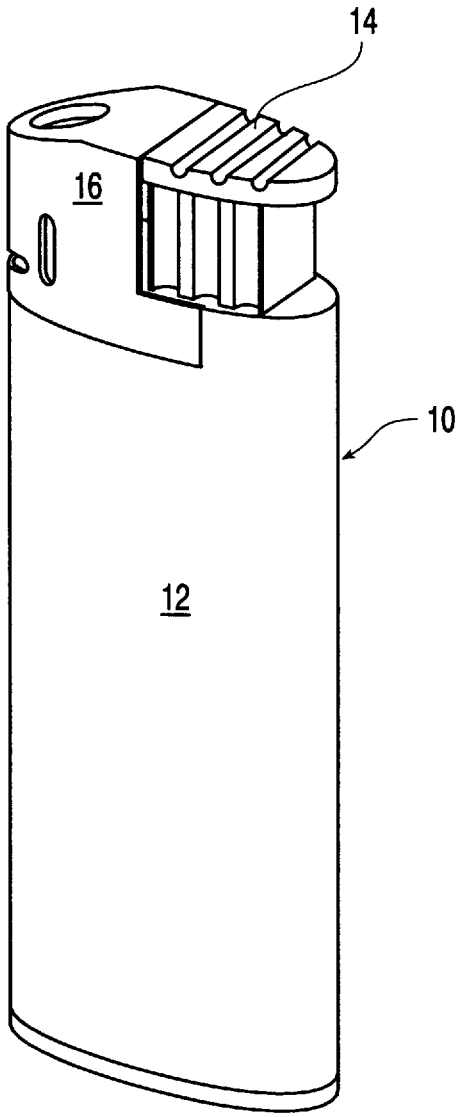
FIG. 1 is a partial perspective view of one embodiment of a lighter according to the present invention in its idle configuration.

Referring to FIG. 1, a partial view of a first illustrative embodiment of the present invention is provided, in which lighter 10 is comprised of body portion 12, depressible valve actuator 14, and wind guard 16.

Figure 2:
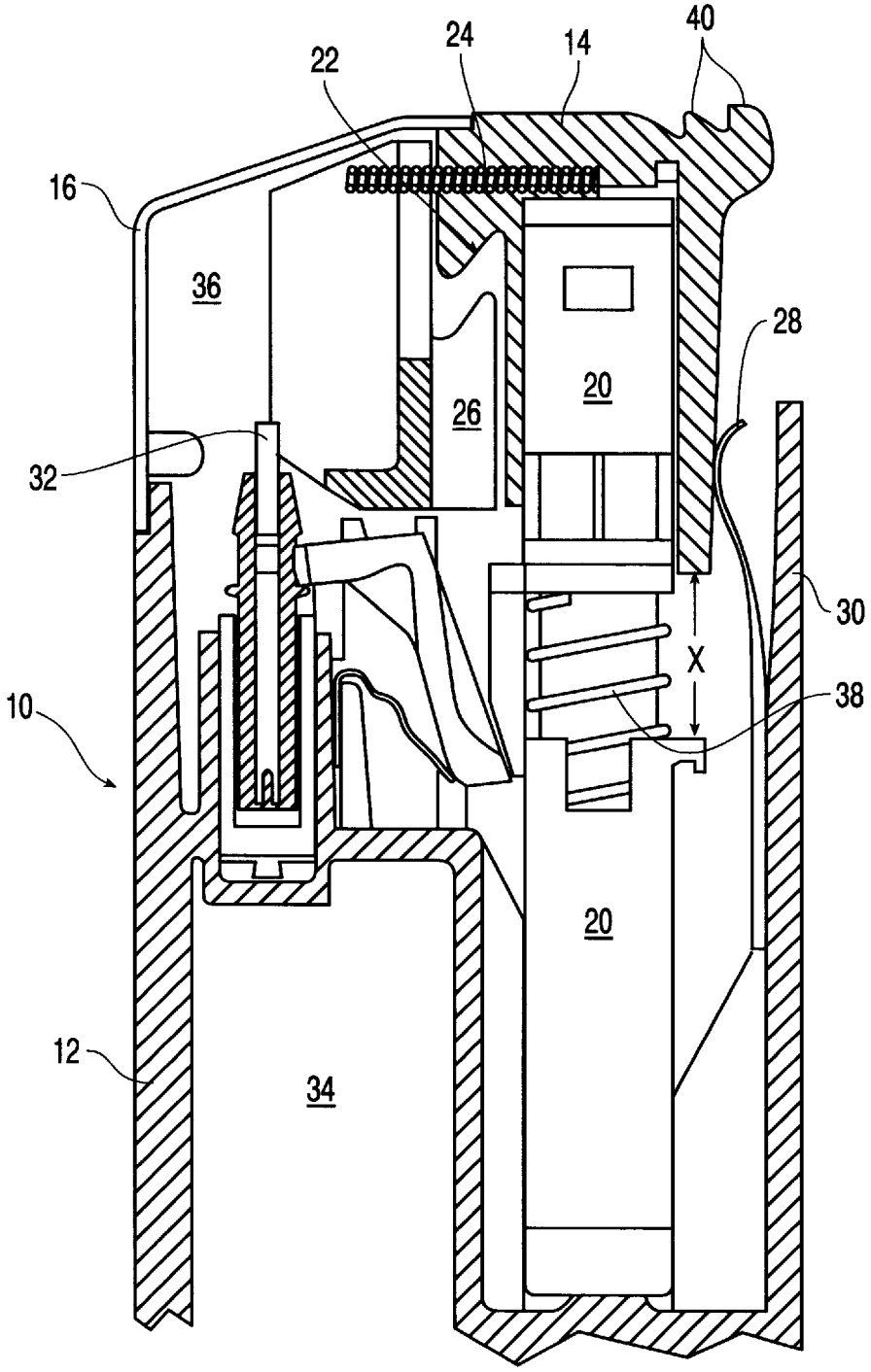
FIG. 2 is a partial cross-sectional view of the lighter depicted in FIG. 1.

Referring now to FIG. 2, further details of the ignition system and safety feature of lighter 10 are depicted. An upper portion of piezoelectric ignition mechanism 20 is connected to actuator 14, as is blocking ridge 22. Spark conductor 24 is electrically connected to ignition mechanism 20 in a known manner. A lower portion of ignition mechanism 20 is received in a cooperating recess in body 12. Projection 26 is connected to an appropriate section of body portion 12, preferably at an upper central area of the housing. Coil spring 38 is positioned between the upper and lower portions of ignition mechanism 20.

Leaf spring 28 is positioned between rear wall 30 and actuator 14 so as to exert an inward biasing force upon actuator 14 to resist outward movement of the actuator toward rear wall 30 of body 12. Coil spring 38 serves to resist the compression of ignition mechanism 20. Coil spring 38 also applies an upward bias against, thereby resisting the depression of, actuator 14.

The upper and lower portions of ignition mechanism 20 are compressibly joined. When at rest, the upper and lower portions of ignition mechanism 20 are separated by a gap, denoted by X in FIG. 2. In piezoelectric lighters such as the present invention, depression of actuator 14 compresses ignition mechanism 20, thereby causing a hammer (not shown) within ignition mechanism 20 to strike a piezoelectric element (not shown), also within ignition mechanism 20. Depression of actuator 14 also opens the fuel valve, thus releasing fuel from reservoir 34 through nozzle 32. Striking the piezoelectric element, or crystal, produces an electrical impulse that is conducted across spark conductor 24 to ignition cavity 36. An electrical arc is generated across the gap from spark conductor 24 to metal nozzle 32, thus igniting the escaping fuel. The basic operation of disposable piezoelectric lighters is well known.

Figure 3:
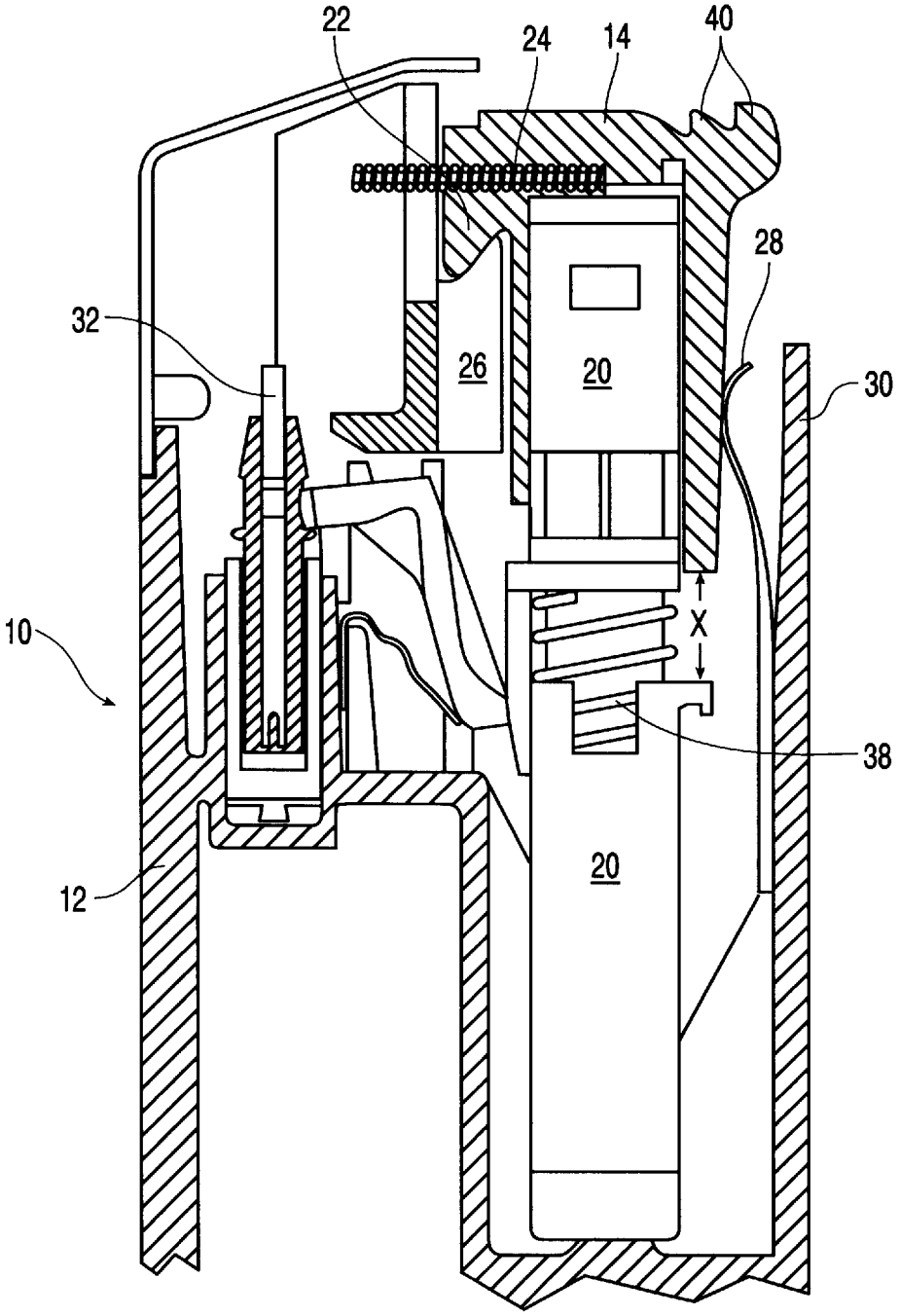
FIG. 3 is a partial cross-sectional view of the lighter depicted in FIG. 1 in a locked position.

In FIG. 2, actuator 14 is shown in its normal or at-rest position. From its normal position, depression of actuator 14 will cause blocking ridge 22 to engage projection 26, thus allowing only minimal, if any, compression of ignition mechanism 20. Referring now to FIG. 3, actuator 14 is depressed as far as blocking ridge 22 and projection 26 will allow. The upper and lower portions of ignition mechanism 20 remain separated by distance X' and cannot be compressed sufficiently to activate the ignition system, thus preventing the production of a flame.

Figure 4:
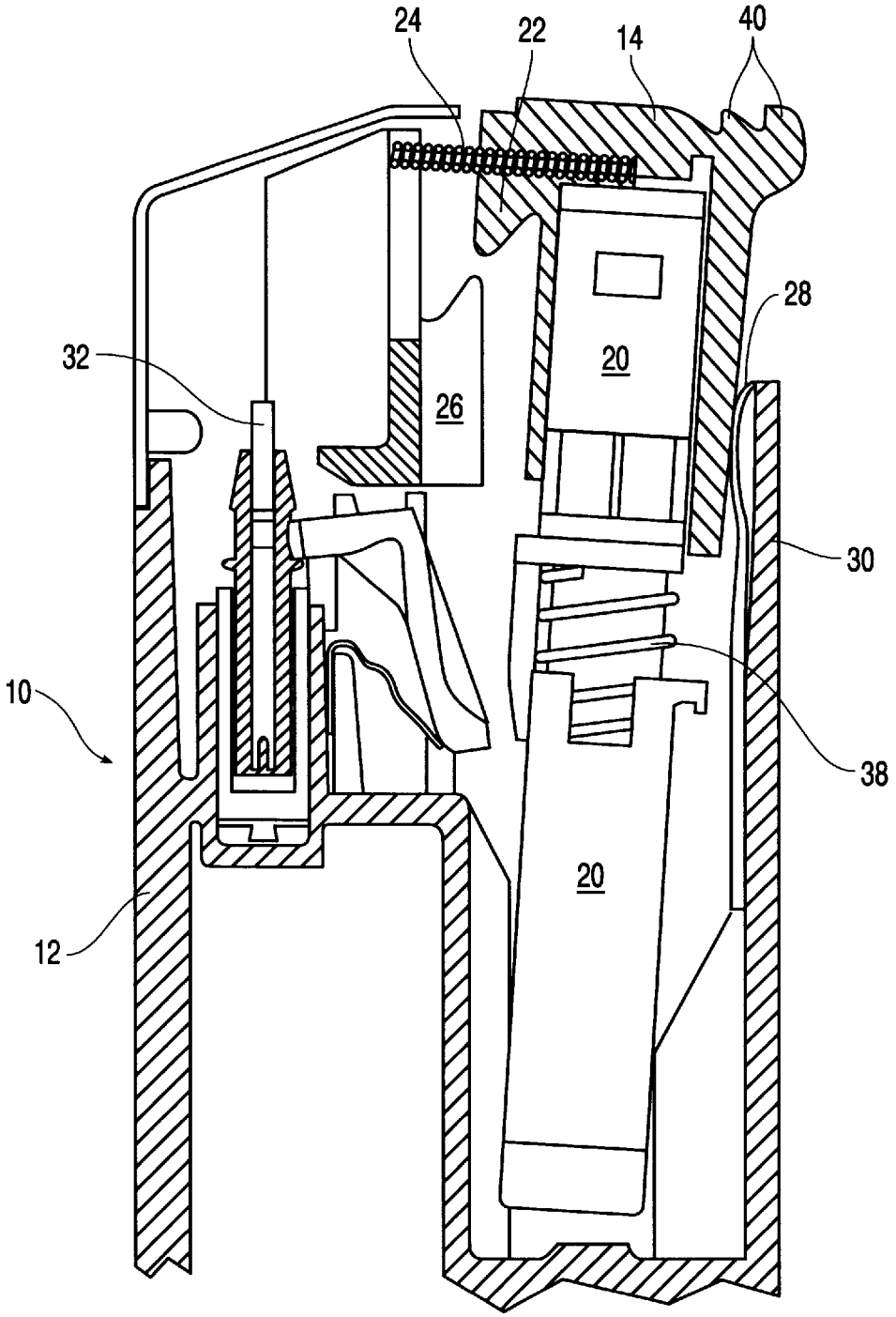
FIG. 4 is a partial cross-sectional view of the lighter depicted in FIG. 1, in which the actuator is displaced prior to activation of the ignition system.

In order for intended users to operate lighter 10, actuator 14 must first be displaced outwardly or rearwardly from nozzle 32, away from its normal position. Alternatively, the actuator may be moved away from the nozzle in a sideways motion. When moved to this "ready" position, demonstrated in FIG. 4, the biasing force of leaf spring 28 has been overcome by an outward force applied by the user. It can also be seen that outward displacement of actuator 14 causes ignition mechanism 20, spark conductor 24, and blocking ridge 22 to be proportionally displaced. To aid the user in displacing actuator 14 from the normal position to the ready position, in the present embodiment of the invention the rear surface of actuator 14 may be shaped to increase friction between actuator 14 and the user. Illustratively, this may be accomplished by forming actuator 14 to include one or more ridges 40.

Figure 5:
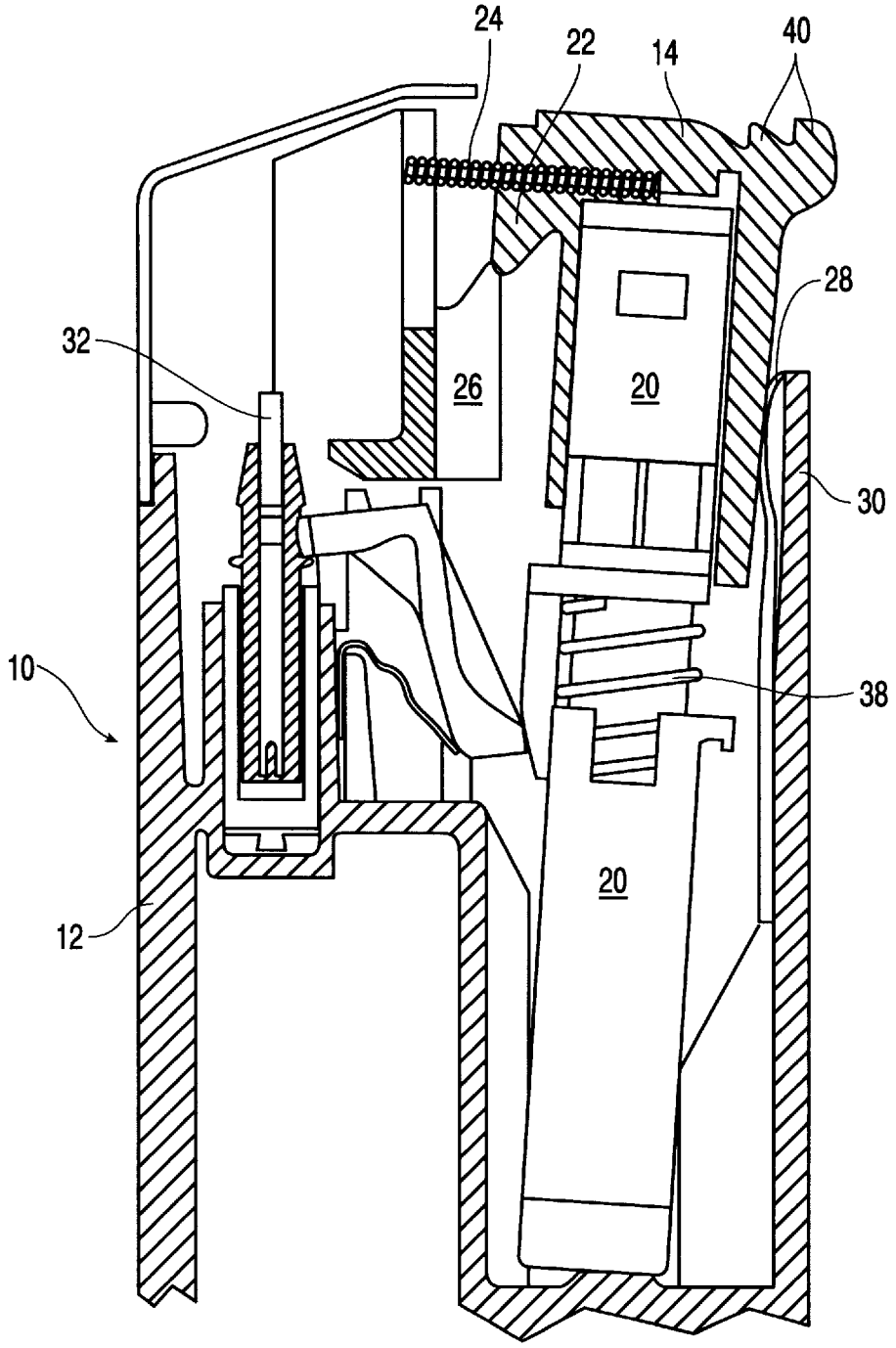
FIG. 5 is a partial cross-sectional view of the lighter depicted in FIG. 1 in an ignition position.

In the ready position, blocking ridge 22 is clear of projection 26. Thus, as shown in FIG. 5, actuator 14 can be depressed by the user in order to cause the activation of the ignition system, at which time the gap between the upper and lower portions of ignition mechanism 20, denoted by X" in FIG. 5, is at a minimum. The upward bias exerted by coil spring 38 forces actuator 14 upward when the downward pressure applied by the user is removed. The combined inward and upward biases imparted by leaf spring 28 and coil spring 38, respectively, ensure that lighter 10 returns to the normal (locked) position after use.

The description this embodiment is intended to be illustrative, not limitative. Thus, it will be apparent to those skilled in the art that modifications may be made to the invention as described without departing from the scope of the claims set out below. For example, spring 38 is illustrated as a coil spring, but any other suitable biasing element may be employed, such as a separate leaf spring or integrally molded plastic spring. Leaf spring 28 may also be replaced by other flexible biasing means, as described above.

The ignition system described herein is not limited to use in a lighter. The ignition system can also be incorporated in other devices that require an enhanced child resistant mechanism, such as piezoelectric ignitions for gas grills, etc.

We claim:

1. A lighter resistant to use by unintended users, comprising:

an elongated housing having a fuel compartment;

a nozzle for supplying fuel from said fuel compartment;

ignition means for igniting said fuel;

an actuator operatively engaged with said ignition means, such that movement of said actuator from a first elevation to a second elevation actuates said ignition means;

blocking means for preventing movement of said actuator from said first elevation to said second elevation; and wherein displacement of said actuator in a direction away from said nozzle disengages said blocking means to allow said actuator to be moved from said first elevation to said second elevation.

2. The lighter of claim 1 in which said blocking means is not capable of movement independent of said actuator.

3. The lighter of claim 1, wherein said blocking means comprises:

a first projection from said actuator; and a second projection secured to the housing for cooperating with said first projection in a first position to prevent actuation.

4. The lighter of claim 3 in which:

said first projection comprises a downward protruding tongue; and said second projection comprises a groove for receiving said first projection.

5. The lighter of claim 4 wherein engagement of said tongue and said groove:

prevents movement of said actuator from said first elevation to said second elevation; and prevents displacement of said actuator in a direction away from said nozzle.

6. The lighter of claim 1 wherein said actuator is tiltable relative to the elongated housing.

7. The lighter of claim 1 in which said actuator is moved from said first elevation to said second elevation by the force of a user; and wherein said actuator automatically returns to said first elevation from said second elevation when the force is removed.

8. The lighter of claim 1 in which said actuator is normally in an unactuable position, in which said blocking means prevents movement of said actuator from said first elevation to said second elevation.

9. The lighter of claim 8 in which displacement of said actuator from said unactuable position to an actuable position places said actuator in an actuable condition from which said actuator is capable of being moved from said first elevation to said second elevation.

10. The lighter of claim 1 wherein said actuator comprises an upper surface, said upper surface comprising a ridge.

11. A lighter resistant to operation by unintended users, comprising:

a body portion having a fuel compartment;

ignition means for igniting fuel from the fuel compartment;

a tiltable actuator normally in an unactuable position;

means for resisting tilted displacement of said actuator; and blocking means for blocking depression of said actuator from said unactuable position;

wherein tilted displacement of said actuator allows depression of said actuator.

12. The lighter of claim 11 wherein:

said ignition means is coupled with said actuator; and tilted displacement of said actuator comprises tilted displacement of said actuator relative to the body portion.

13. The lighter of claim 11 wherein:

said blocking means comprises a downward protrusion integral with said actuator;

the body portion comprises an upward projection for engaging said downward protrusion; and said downward protrusion interlocks with said upward projection when said actuator is depressed from said unactuable position;

wherein said interlock of said downward protrusion and said upward projection prevents activation of the ignition means.

14. The lighter of claim 11 wherein:

said actuator is tiltable rearwardly to an actuable position under a force applied by a user; and depression of said actuator when in said actuable position activates the ignition means.

15. The lighter of claim 14, wherein upon removal of the force said actuator automatically returns to said unactuable position.

16. The lighter of claim 11 wherein said actuator comprises an upper surface, said upper surface comprising a ridge.

* * * * *

UNITED STATES PATENT AND TRADEMARK OFFICE

CERTIFICATE OF CORRECTION

PATENT NO. : 5,833,448
DATED : November 10, 1998
INVENTOR(S) : Doucet et al.

It is certified that error appears in the above-identified patent and that said Letters Patent is hereby corrected as shown below:

Title page,
Category 56 -- References Cited: after the line reading "U.S. Patent Documents", insert

| | | | |
|---|---|---|---|
| -- 3,169,672 | 2/1965 | Soffer et al. | 222/153 |
| 3,898,031 | 8/1975 | Rusakowicz | 431/130 |
| 4,424,920 | 1/1984 | Tada | 222/402.11 |
| 4,752,020 | 6/1988 | Grueter et al. | 222/402.15 |
| 4,784,602 | 2/1990 | Nitta | 431/153 |
| 4,904,180 | 11/1988 | Nitta | 431/153 |
| 4,962,869 | 10/1990 | Gross et al. | 222/153 |
| 5,035,608 | 7/1991 | Parren | 431/153 |
| 5,145,358 | 9/1992 | Shike et al. | 431/153 |
| 5,655,901 | 8/1997 | Makoto | 431/153 |
| 5,676,537 | 1/1998 | Fang | 431/153 |
| 5,704,776 | 8/1998 | Sher | 431/153 |

FOREIGN DOCUMENTS

| | | |
|---|---|---|
| 2,295,359 | 12/1973 | France --. |

Signed and Sealed this

Eighteenth Day of September, 2001

*Attest:*

Nicholas P. Godici

NICHOLAS P. GODICI
*Acting Director of the United States Patent and Trademark Office*

*Attesting Officer*